US011732717B2

(12) United States Patent
Burke et al.

(10) Patent No.: US 11,732,717 B2
(45) Date of Patent: Aug. 22, 2023

(54) MULTISTAGE CENTRIFUGAL GRINDER PUMP

(71) Applicant: Sulzer Management AG, Winterthur (CH)

(72) Inventors: Michael Burke, County Wexford (IE); Ian Cullen, County Wexford (IE)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 16/263,744

(22) Filed: Jan. 31, 2019

(65) Prior Publication Data

US 2019/0264690 A1 Aug. 29, 2019

(30) Foreign Application Priority Data

Feb. 23, 2018 (EP) ..... 18158444

(51) Int. Cl.
*F04D 1/06* (2006.01)
*F04D 7/04* (2006.01)
(Continued)

(52) U.S. Cl.
CPC ..... *F04D 1/06* (2013.01); *F04D 7/045* (2013.01); *F04D 29/426* (2013.01); *F04D 29/445* (2013.01); *F04D 29/448* (2013.01)

(58) Field of Classification Search
CPC ..... F04D 1/04; F04D 1/06; F04D 1/08; F04D 1/10; F04D 1/14; F04D 7/045; F04D 29/426
(Continued)

(56) References Cited

U.S. PATENT DOCUMENTS 1,387,660 A * 8/1921 Ostenberg ..... F04D 1/063 415/199.3
5,659,214 A * 8/1997 Guardiani ..... F04D 7/045 310/90
(Continued)

FOREIGN PATENT DOCUMENTS

CN 105683581 A 6/2016
CN 106133325 A 11/2016
(Continued)

OTHER PUBLICATIONS

Extended European Search Report dated Jun. 18, 2019 in corresponding European Patent Application No. 19152370.3.
(Continued)

*Primary Examiner* — Justin D Seabe
*Assistant Examiner* — Aye S Htay
(74) *Attorney, Agent, or Firm* — Global IP Counselors, LLP

(57) ABSTRACT

A multistage centrifugal grinder pump includes a grinder to grind a fluid, a first stage impeller, a second stage impeller, a stationary diffusor arranged between the first stage impeller and the second stage impeller to guide the fluid from the first stage impeller to the second stage impeller and a shaft to rotate the first stage impeller, the second stage impeller and the grinder. The first and second stage impellers in series and connected to the shaft in a torque-proof manner. The diffusor is a semi-open diffusor having a top wall, a radially outer annular side wall, and an open bottom side facing the first stage impeller, the top wall arranged adjacent the second stage impeller, the top wall having a central outlet opening surrounding the shaft, and the open bottom side extending beyond the first stage impeller with respect to a radial direction.

18 Claims, 8 Drawing Sheets

(51) Int. Cl.
*F04D 29/42* (2006.01)
*F04D 29/44* (2006.01)

(58) Field of Classification Search
USPC ..... 415/121.1
See application file for complete search history.

(56) References Cited

U.S. PATENT DOCUMENTS

| | | | | |
|---|---|---|---|---|
| 6,343,913 | B1 | 2/2002 | Ohsaki | |
| 7,357,341 | B2 * | 4/2008 | Gutwein | F04D 29/426 241/46.11 |
| 7,841,826 | B1 * | 11/2010 | Phillips | E21B 43/128 415/121.1 |
| 2006/0269404 | A1 | 11/2006 | Volk | |

FOREIGN PATENT DOCUMENTS

| | | | |
|---|---|---|---|
| DE | 19543916 | A1 | 5/1996 |
| EP | 3492749 | A1 | 6/2019 |
| JP | H06323291 | A | 11/1994 |

OTHER PUBLICATIONS

Extended European Search Report dated Jul. 30, 2018 in corresponding European Patent Application No. 18158444.2, filed Feb. 23, 2018.
English Translation of DE19543916 A1, Centrifula pump for waste water contg. solids, May 30, 1996, 9 pages.

* cited by examiner

MULTISTAGE CENTRIFUGAL GRINDER PUMP

CROSS-REFERENCE TO RELATED APPLICATION

This application claims priority to European Application No. 18158444.2, filed Feb. 23, 2018, the contents of which are hereby incorporated herein by reference.

FIELD OF THE INVENTION

The invention relates to a multistage centrifugal grinder pump.

BACKGROUND OF THE INVENTION

In the conveying of sewage or waste water and in particular of domestic waste water, problems result because such liquids contain constituents such as fibrous materials, cloths, textiles, rags, plastic bags or other solids which can very easily become stuck in the region of the pump and can then result in a reduction in the efficiency, in particular the hydraulic efficiency, of the pump up to the complete blocking of the impeller of the pump and can cause servicing or also complex and/or expensive maintenance work. Special measures therefore have to be taken with such pumps in order to effectively prevent clogging. A known solution to address this problem are centrifugal grinder pumps that are also referred to as centrifugal macerator pumps. These pumps are provided with a rotating grinder at the pump inlet for grinding the constituents in the sewage. Typically, the grinder is configured as a cutting device rotating in or at the pump inlet for disintegrating or shredding the solid constituents in the sewage and thus preventing a clogging of the pump impeller.

Quite often residential but also industrial sewer systems are only based upon gravity to discharge the sewage to larger reservoirs or treatment plants. However, if gravity is not sufficient to move the sewage to the desired location or if gravity based systems are not economical, grinder pumps are used to lift the sewage or to convey the sewage over longer distances. To this end grinder pumps are integrated for example in residential pressure sewerage systems (PPS) or gravity sewerage systems to provide an effective and economical dewatering. Usually grinder pumps use quite small-diameter discharge lines in all applications, such as in the private or municipal or industrial area. Centrifugal grinder pumps may be designed as submersible pumps, i.e. as pumps that are configured to operate even if they are completely submerged and covered by the fluid to be conveyed.

A critical parameter of sewage pumps is the head-flow range in which they can be operated. In some applications the required head is very high, for example for lifting the sewage a head of up to 200 ft (61 m) or even more may be required. Such a high head in combination with a reasonable flow rate of e.g. up to 7 $m^3/h$ is at least very difficult if not impossible to realize with a centrifugal grinder pump having only one impeller. Therefore two stage centrifugal grinder pumps having two impellers arranged in series have been developed to increase the available head of the sewage pump.

U.S. Pat. No. 7,357,341, for example, discloses a two stage centrifugal grinder pump with two impellers in series. The pump housing comprises an inlet, at which the grinder is positioned, a first stage volute, in which the first impeller is positioned and a second stage volute, in which the second impeller is positioned. The first stage volute is in fluid communication with the inlet of the pump. The discharge of the first stage volute is connected to the inlet of the second stage volute by an interstage conduit. The discharge of the second stage volute is in fluid communication with the outlet of the pump housing. The interstage conduit is arranged at the outside of the pump housing and wrapping around the pump housing to guide the flow of fluid from the discharge of the first stage volute to the inlet of the second stage volute. This overall design has the disadvantage to require quite a lot of space.

DE 195 43 916 also discloses a two stage centrifugal grinder pump. According to this design the fluid is guided within the pump housing from the first impeller to the second impeller, i.e. this design does not require an interstage conduit arranged at the outside of the pump housing.

SUMMARY

Starting from this state of the art it is an object of the invention to propose a different and very compact as well as efficient multistage centrifugal grinder pump, which can generate a high head, for example of up to 200 ft (61 m) or even more. In particular, the risk of a clogging of the pump shall be avoided or at least considerably reduced.

The subject matter of the invention satisfying this object is characterized by the features of the embodiments of the invention described herein.

Thus, according to the invention a multistage centrifugal grinder pump is proposed, comprising a housing with a pump inlet for a fluid to be conveyed, and a pump outlet for discharging the fluid, further comprising a grinder arranged at the pump inlet for grinding constituents of the fluid, a first stage impeller for rotating about an axial direction, a second stage impeller for rotating about the axial direction, a stationary diffusor arranged with respect to the axial direction between the first stage impeller and the second stage impeller for guiding the fluid from the first stage impeller to the second stage impeller, and a shaft for rotating the first stage impeller, the second stage impeller and the grinder, wherein the first stage impeller and the second stage impeller are arranged in series and are connected to the shaft in a torque-proof manner, wherein the diffusor is designed as a semi-open diffusor having a top wall, a radially outer annular side wall, and an open bottom side facing the first stage impeller, wherein the top wall is arranged adjacently to the second stage impeller, wherein the top wall has a central outlet opening surrounding the shaft, and wherein the open bottom side extends beyond the first stage impeller with respect to a radial direction.

By providing the centrifugal grinder pump with two impellers arranged in series, i.e. one after the other with respect to the axial direction, the head-flow range, in which the pump may be operated, is considerably extended as compared to pumps with only one impeller. In particular, the head that can be generated with the multistage centrifugal grinder pump is remarkably increased, so that the pump according to the invention is particularly suited for high head applications requiring a head of, for example, up to 200 feet (61 meters) or even more. Typical flow rates that may be achieved with the pump according to the invention are for example in the range of 1-7 $m^3/h$.

In addition, since the centrifugal grinder pump according to the invention is designed with an internal stationary diffusor for guiding the fluid conveyed by the first stage impeller to the second stage impeller, the pump according to the invention is very compact, because there is no need for an interstage conduit arranged at the outside of the housing and wrapping around the housing.

In particular, the semi-open design of the diffusor considerably contributes to prevent a clogging of the pump. Semi-open design means that the diffusor has the top wall but no bottom wall or any other partition projecting beyond the first stage impeller with respect to the radial direction at the bottom side of the diffusor. Thus, the diffusor has a generally cup-shaped or pot-shaped design. The diffusor is completely open at the bottom side facing the first stage impeller and the open bottom side extends beyond the first stage impeller with respect to the radial direction. Due to the open bottom side of the diffusor a collecting or sticking of solid constituents is prevented or at least considerably reduced. This also increases the efficiency of the pump.

The top wall of the diffusor generally extends perpendicular to the axial direction, i.e. in radial direction, and the central, preferably circular, outlet opening is arranged around the shaft, so that the fluid is guided by the diffusor to the center of the second stage impeller.

Preferably, the centrifugal grinder pump comprises a pump chamber for accommodating the impellers, wherein the diffusor divides the pump chamber in a first chamber, in which the first stage impeller is arranged, and in a second chamber, in which the second stage impeller is arranged. The fluid is guided from the first chamber along the diffusor and enters the second chamber through the central outlet opening in the top wall of the diffusor.

Due to the diffusor between the first chamber and the second chamber it can be dispensed with designing the first and the second chamber as volute chambers. Therefore it is preferred, that the first chamber and the second chamber each have a circular cross-section perpendicular to the axial direction. This measure makes the design and the manufacturing of the pump considerably simpler.

As a preferred measure a plurality of diffusor elements is disposed at the top wall of the diffusor for guiding the fluid from the first stage impeller to the second stage impeller, with each diffusor element extending with respect to the axial direction towards the first stage impeller. The diffusor elements support an efficient guidance of the fluid from the first stage impeller to the second stage impeller. Particularly preferred, each diffusor element extends with respect to the axial direction nearly to the first stage impeller, such that there is only a running clearance between the stationary diffusor elements and the rotating impeller blades of the first stage impeller.

Preferably, each diffusor element is arranged at the central outlet opening of the top wall and extends in the radial direction, with the extension in the radial direction being such, that the first stage impeller projects beyond each diffusor element regarding the radial direction. According to a preferred embodiment each diffusor element has an essentially drop-shaped design with the thinner end located at the central outlet opening. The rounded thicker end is located radially more outwardly at the top wall of the diffuser.

In order to guide the flow of fluid from the first to the second stage impeller even more efficiently, it is preferred, that the diffusor elements are equidistantly distributed with respect to the circumferential direction of the top wall of the diffusor.

According to a preferred embodiment the diffusor of the pump has at least four diffusor elements, preferably exactly four diffusor elements.

As a further preferred measure the top wall of the diffusor has a top surface facing the second stage impeller, wherein the top surface includes a plurality of grooves for cleaning out solid constituents of the fluid. This measure further reduces the risk of clogging, in particular of a clogging of the second stage impeller.

According to a preferred embodiment the diffusor comprises a mounting flange for attaching the diffusor to the housing, and a plurality of securing elements arranged at the mounting flange for fixing the diffusor to the housing, wherein the mounting flange is designed and arranged in such a manner that the securing elements are accessible from the outside of the pump. By this measure it is possible to adjust the position of the diffusor even after the assembly of the pump. Furthermore, even when the pump is already in operation the position of the diffusor may be readjusted without dissembling the pump.

Preferably, the housing comprises a base plate arranged at the pump inlet, and a pump casing delimiting the pump chamber, wherein the diffusor is fixed to the pump casing.

According to a preferred design the diffusor is interposed between the base plate and the pump casing.

Furthermore it is preferred that the centrifugal grinder pump comprises a drive unit for rotating the shaft about the axial direction, wherein the drive unit is arranged within the housing, and wherein the first stage impeller and the second stage impeller are arranged between the drive unit and the grinder with respect to the axial direction. It is a very compact design to arrange the drive unit within the housing of the pump. Of course, the housing may be designed to comprise two or more housing parts that are assembled and firmly fixed with respect to each other, e.g. by screws or bolts, to form the housing of the pump.

Most preferred, the multistage centrifugal grinder pump is designed for a vertical operation with the shaft extending in the vertical direction, wherein the drive unit is arranged above the first stage impeller and the second stage impeller. During operation the shaft is oriented in the direction of gravity and the axial direction extends vertically. In this configuration the pump inlet with the grinder is located at the bottom of the pump, the first stage impeller is arranged above the grinder, the second stage impeller is arranged above the first stage impeller and the drive unit is positioned on top of the second stage impeller. The shaft extends vertically from the drive unit to the grinder for rotating the first and the second stage impeller as well as the grinder about the axial direction.

In particular for sewage and dewatering applications it is preferred that the pump is configured as a submersible pump.

According to a particularly preferred embodiment the multistage centrifugal grinder pump is configured as a two stage pump having exactly two impellers, namely the first stage impeller and the second stage impeller.

However it is also possible to configure the multistage centrifugal grinder pump according to the invention with three or even more stages, wherein the number of stages equals the number of impellers that are provided in the pump. In embodiments with three or more stages, a stationary diffusor is arranged respectively between each pair of adjacent impellers. For example, in a three stage pump having a first, a second and a third stage impeller a first diffusor is arranged between the first and the second stage impeller, and a second diffusor is arranged between the second stage and the third stage impeller.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
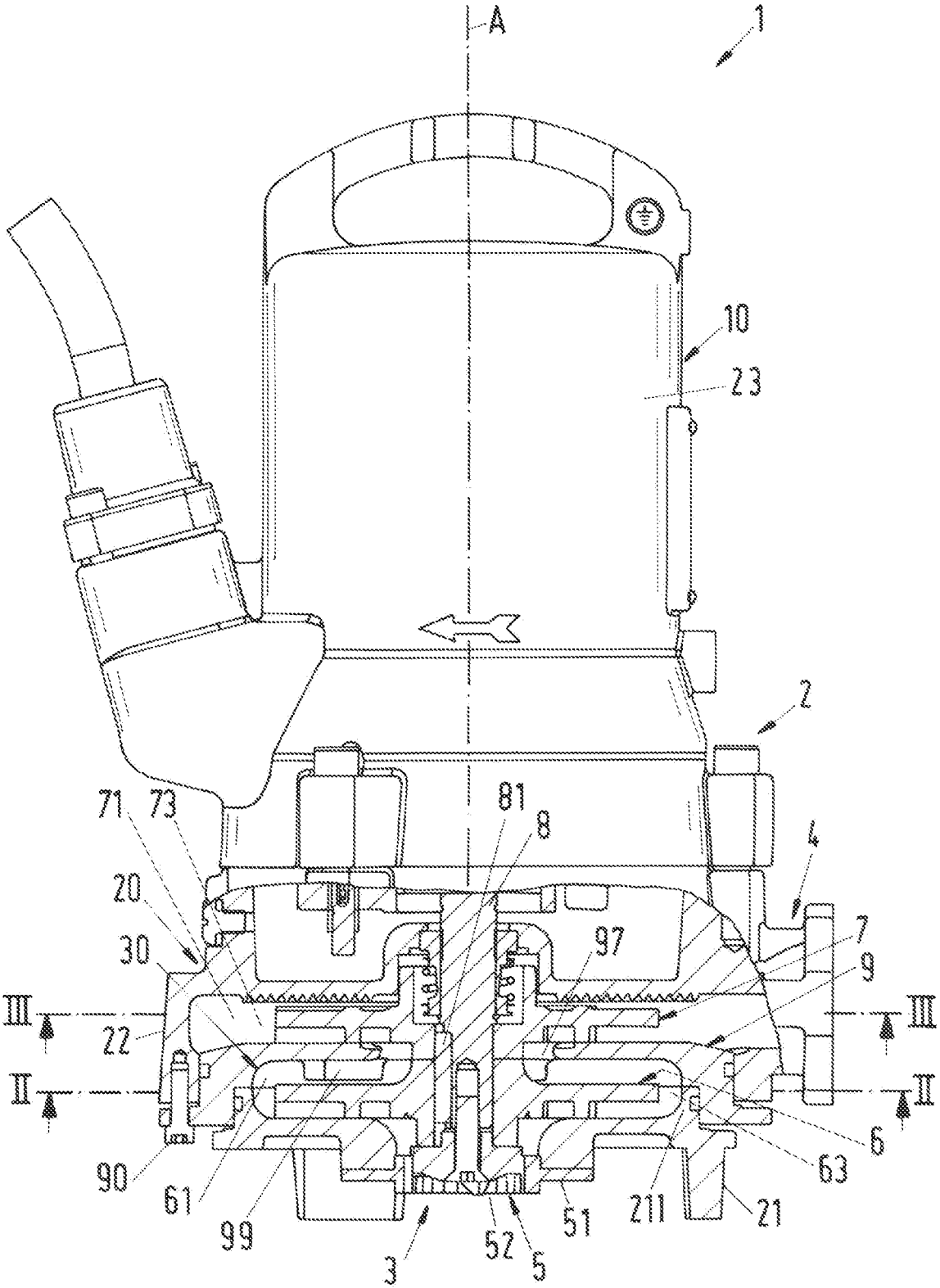
FIG. 1 is a break-out section view of an embodiment of a multistage centrifugal grinder pump according to the invention.

In the following description reference is made by way of example to the important application that the multistage centrifugal grinder pump is used for conveying sewage or wastewater in private, municipal or industrial areas. The sewage typically comprises solid constituents such as fibrous materials, cloths, textiles, rags, paper, plastic bags or other solids. FIG. 1 shows an overall view of an embodiment of a multistage centrifugal grinder pump according to the invention which is designated in its entity with reference numeral 1. This embodiment is configured as a two stage pump 1. The pump 1 comprises a housing 2, in which a pump unit 20 and a drive unit 10 are arranged. FIG. 1 is a break-out section view showing the pump unit 20 in a cross-sectional view and the rest of the centrifugal pump 1 in a view on the housing 2 of the pump 1.

The housing 2 has a pump inlet 3 for a fluid to be conveyed and a pump outlet 4 for discharging the fluid. The fluid is for example sewage or wastewater comprising beside water also solid constituents as mentioned before.

As shown in FIG. 1 the housing 2 may comprise several housing parts, which are connected to each other to form the housing 2 for the pump unit 20 and the drive unit 10. In particular, the housing 2 comprises a base plate 21 arranged at the pump inlet 3, a pump casing 22 and a motor casing 23 for accommodating the drive unit 10. The base plate 21 is also referred to as wear plate.

The centrifugal grinder pump 1 is configured as a submersible pump 1, which can be operated also, when the pump 1 is partially or completely submerged in a liquid, e.g. the sewage or the wastewater that shall be conveyed by the pump 1.

As it is typical for a centrifugal grinder pump 1 a grinder 5 is arranged at the pump inlet 3, so that the fluid can only enter the pump 1 by passing the grinder 5. The grinder 5 comprises a stationary shredding ring 51 fixed to the base plate 21 of the housing 2 and a cutting device 52 rotating during operation for shredding or disintegrating the solid constituents of the sewage so that they cannot clog the pump 1. Since the grinder 5, which is also referred to as macerator, as such is well-known in the art in many different designs and configurations, there is no need to describe or explain the grinder 5 in more detail. Basically the grinder 5 may be configured according to any design that is suited for shredding or cutting assemblies in connection with pumps.

The centrifugal grinder pump 1 further comprises two impellers 6, 7 arranged in series for acting on the fluid, namely a first stage impeller 6 and a second stage impeller 7. During operation both impellers 6, 7 rotate about the same rotational axis, which defines an axial direction A. For driving the rotation of the impellers 6, 7 as well as the rotation of the grinder 5 a shaft 8 is provided extending in the axial direction A. The shaft 8 is coupled to the drive unit 10, which rotates the shaft 8 about the axial direction A. Thus, the longitudinal axis of the shaft 8 coincides with the rotational axis and therefore defines the axial direction A.

A direction perpendicular to the axial direction A is referred to as 'radial direction'. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'.

The two stage centrifugal grinder pump 1 is designed for a vertical operation with the shaft 8 extending in the vertical direction, i.e. the direction of gravity. Hereinafter relative terms regarding the location like "above" or "below" or "upper" or "lower" or "top" or "bottom" refer to the usual operating position of the pump 1. FIG. 1 shows the centrifugal grinder pump 1 in its usual operating position.

The drive unit 10 is arranged on top of the pump unit 20, i.e. above the first and the second stage impeller 6, 7. Preferably, the drive unit 10 comprises an electric motor for driving the shaft 8. The electric motor may be configured in many different manners which are known in the art. In particular, the electric motor is designed or encapsulated in the housing 2 for being submerged.

As can be seen in FIG. 1, the pump inlet 3 with the grinder 5 is centrally arranged at the bottom of the pump 1, so that the fluid can enter the pump 1 in a generally axial direction. The first stage impeller 6 is arranged adjacent to the pump inlet 3 and the grinder 5 for receiving the fluid that passed the grinder 5. The second stage impeller 7 is arranged behind the first stage impeller 6 when viewed in the general flow direction of the fluid. The pump outlet 4 is arranged laterally at the housing 2 on the same height (regarding the axial direction A) as the second stage impeller 7. The first stage impeller 6 and the second stage impeller 7 are connected to the shaft 8 in a torque-proof manner, for example by a key lock 81. The shaft 8 is extending from the drive unit 10 upwardly to the grinder 5. The cutting device 52 of the grinder 5 is fixed to the shaft 8, preferably in a torque-proof manner. As can be seen in FIG. 1 the cutting device 52 is mounted to the lower axial end of the shaft 8 and fixed thereto, e.g. by a centrally arranged screw.

Between the first stage impeller 6 and the second stage impeller 7 a stationary diffusor 9 is arranged for receiving the fluid conveyed by the first stage impeller 6 and guiding the fluid to the second stage impeller 7. A more detailed explanation of the diffusor 9 will be given hereinafter.

Figure 2:
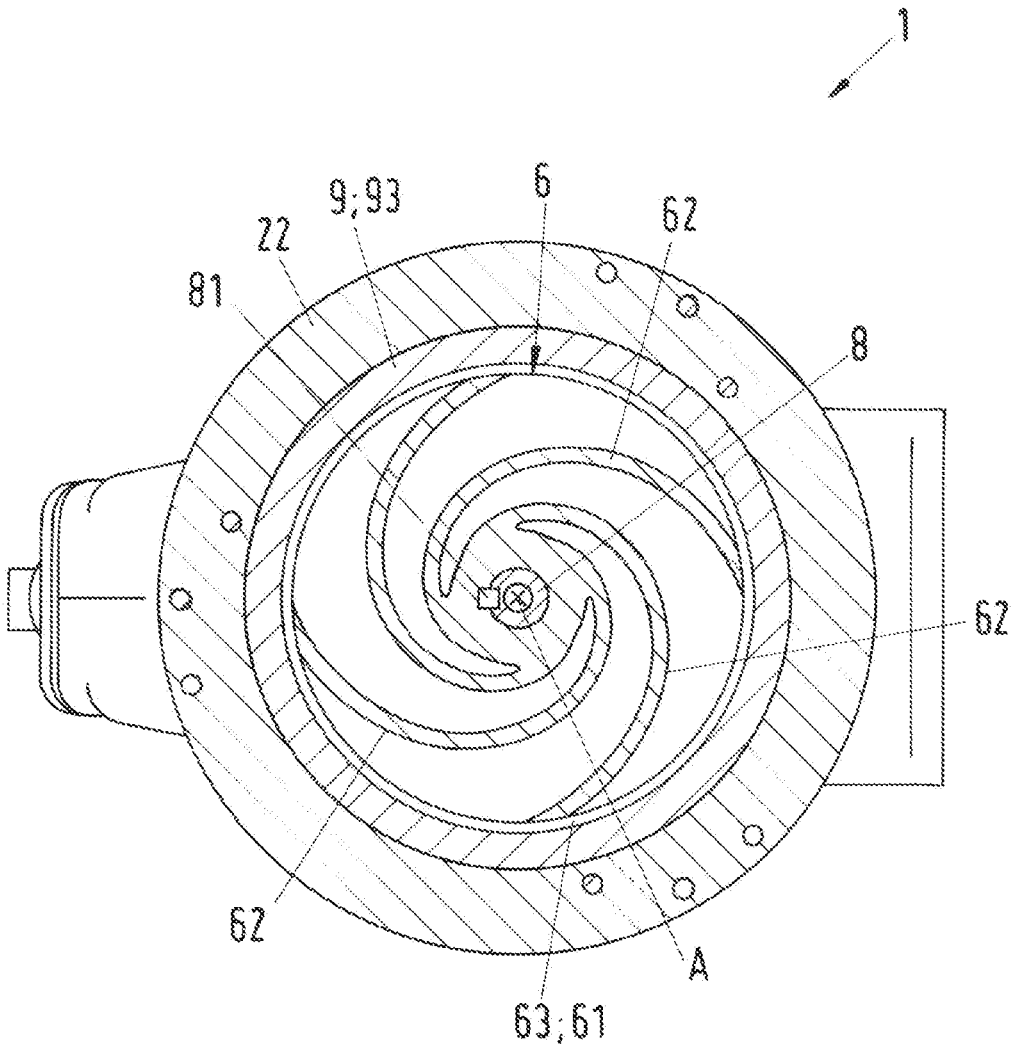
FIG. 2 is a cross-sectional view perpendicular to the axial direction through the first stage impeller along section line II-II in FIG. 1.
Figure 3:
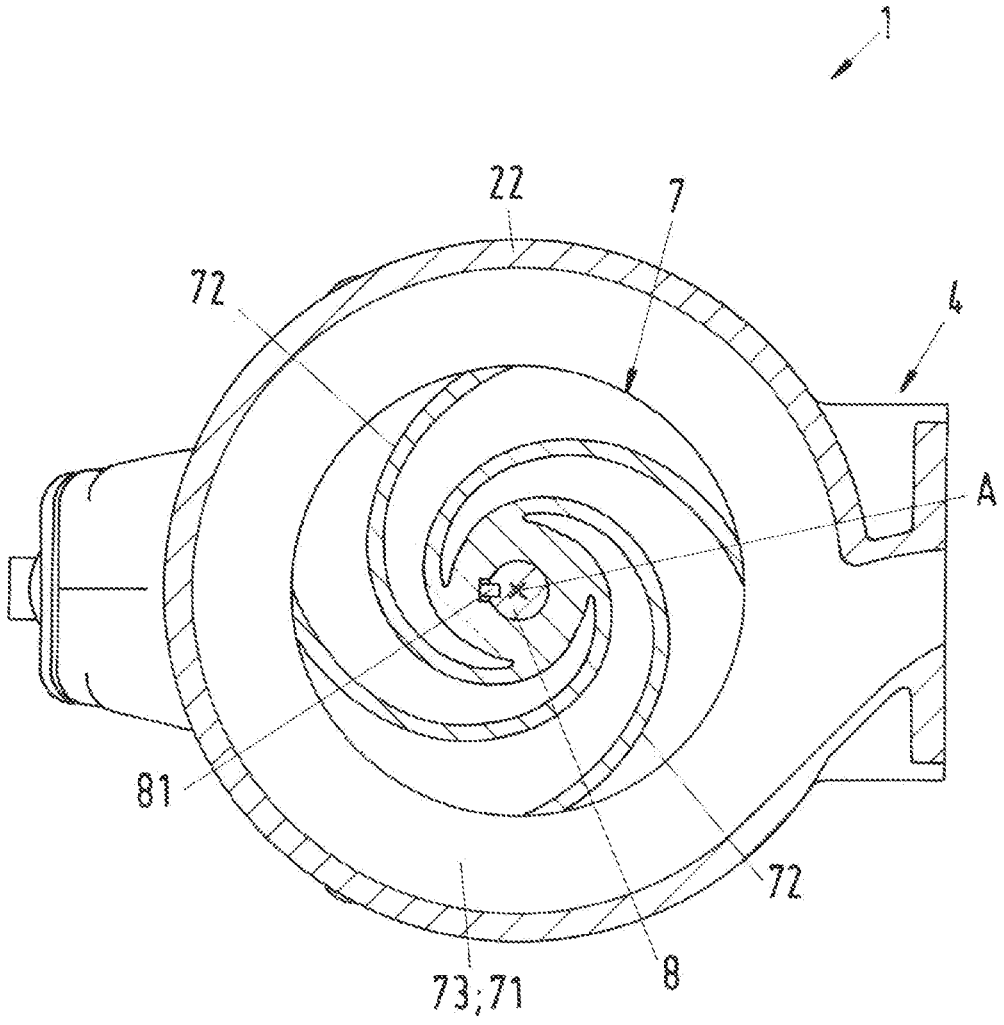
FIG. 3 is a cross-sectional view perpendicular to the axial direction through the second stage impeller along section line III-III in FIG. 1.

For a better understanding, FIG. 2 and FIG. 3 show two cross-sectional views perpendicular to the axial direction A. FIG. 2 shows a section through the midplane of the first stage impeller 6 along the section line II-II in FIG. 1 with the arrows indicating the direction of the view, and FIG. 3 shows a section through the midplane of the second stage impeller 7 along the section line III-III in FIG. 1 with the arrows indicating the direction of the view.

The first stage impeller 6 (FIG. 2) comprises a plurality of first impeller blades 62 for acting on the fluid. The second stage impeller 7 (FIG. 3) comprises a plurality of second impeller blades 72 for acting on the fluid.

The housing 2 comprises a pump chamber 30 (FIG. 1) for accommodating the impellers 6, 7. The diffusor 9 arranged between the first stage impeller 6 and the second stage impeller 7 divides the pump chamber 30 in a first chamber 61, in which the first stage impeller 6 is arranged, and a second chamber 71, in which the second stage impeller 7 is arranged. As can be best seen in FIG. 2 and FIG. 3, respectively, both the first chamber 61 and the second chamber 71 have an essentially circular cross-section perpendicular to the axial direction A. The diameter of the first chamber 61 may be the same as or may be different from the diameter of the second chamber 71. In the illustrated embodiment, the diameter of the second chamber 71 is larger than the diameter of the first chamber 61, as can be best seen in FIG. 1.

The diameter of the first and the second chamber 61, 71 is in each case larger than the outer diameter of the respective first or second stage impeller 6, 7, so that there is an essentially annular flow channel 63 or 73, respectively between the radially outer ends of the impeller blades 62 or 72 and the wall delimiting the respective first or second chamber 61, 71 in radial direction. Each flow channel 63, 73 surrounds the respective first or second stage impeller 6, 7.

Both the first and the second stage impeller 6, 7 are centered in the respective first and second chamber 61, 71, meaning that the radial distance between the radially outer end of the respective impeller blades 62 or 72 and the wall delimiting the respective first or second chamber 61, 71 in radial direction is constant when viewed in the circumferential direction of the first or second stage impeller 6, 7, respectively. Thus, both the flow channel 63 of the first chamber 61 and the flow channel 73 of the second chamber 71 have a constant width in radial direction when viewed in the circumferential direction.

It has to be noted that both the first chamber 61 and the second chamber 71 are not designed as volute chambers but with a circular cross-section perpendicular to the axial direction A, which renders the manufacturing simpler.

Regarding the design of the first and the second stage impeller 6, 7, in particular the number and the configuration of the respective impeller blades 62, 72, there is a huge amount of possibilities. For a skilled person it is no problem to choose an appropriate design for the first and the second stage impeller 6, 7. The choice of an appropriate impeller design may depend on the specific application, for example the required head, the required flow and so on. It is however preferred—but not necessary—that the first stage impeller 6 and the second stage impeller 7 have the same design and are at least essentially identical.

The first stage impeller 6 (FIG. 2) and the second stage impeller 7 (FIG. 3) are centrifugal or radial impellers 6, 7 and may be designed for example with a plurality of curved impeller blades 62, 72 as it is shown in FIG. 2 and FIG. 3. In this embodiment each impeller 6, 7 comprises four curved impeller blades 62 or 72, respectively. Each first impeller blade 62 and each second impeller blade 72 are designed to have a wrap angle of approximately 180 degree.

It goes without saying that the first and the second stage impeller 6, 7 may also be designed differently, for example, with splitter ribs between the impeller blades or with other designs that are known for centrifugal pumps. For example, the first stage impeller and the second stage impeller may be designed with straight impeller blades meaning that the impeller blades are not curved but extend straightly and preferably in radial direction. This type of impeller is sometimes called "star impeller" or "Barske impeller".

Referring now in particular to FIG. 4-FIG. 8 the stationary diffusor 9 arranged between the first stage impeller 6 and the second stage impeller 7 with respect to the axial direction A will be explained in more detail.

The diffusor 9 interposed between the first and the second stage impeller 6, 7 directs the fluid that has been acted on by the first stage impeller 6 to the second stage impeller 7, more precisely, the diffusor 9 guides the fluid from the flow channel 63 of the first chamber 61 to the radially inner region of the second stage impeller 7. At the same time the diffusor 9 transforms kinetic energy of the fluid into pressure, i.e. the velocity of the fluid is decreased and the pressure is increased.

Figure 4:
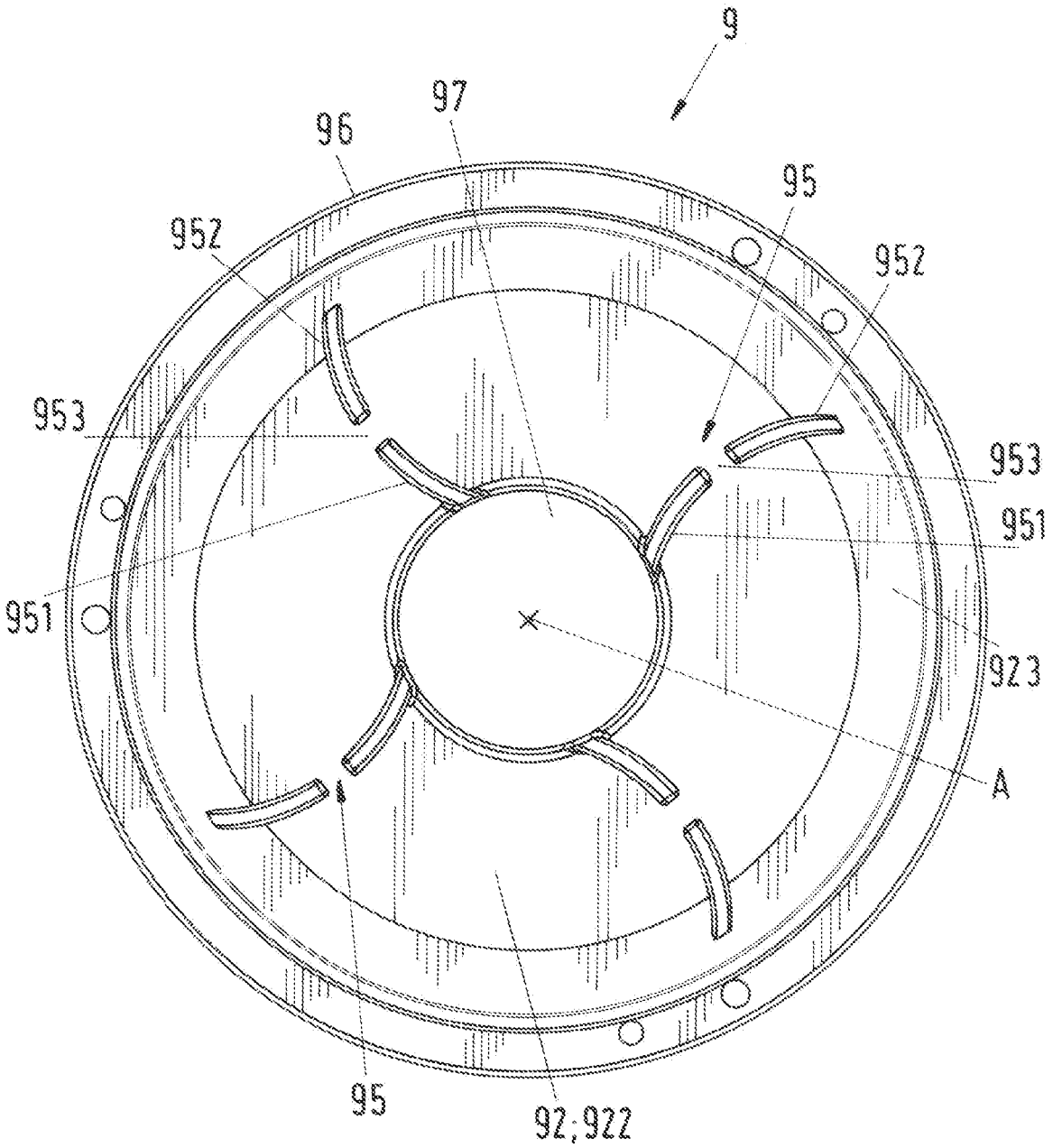
FIG. 4 is a top view of the diffusor as seen from the second stage impeller.
Figure 5:
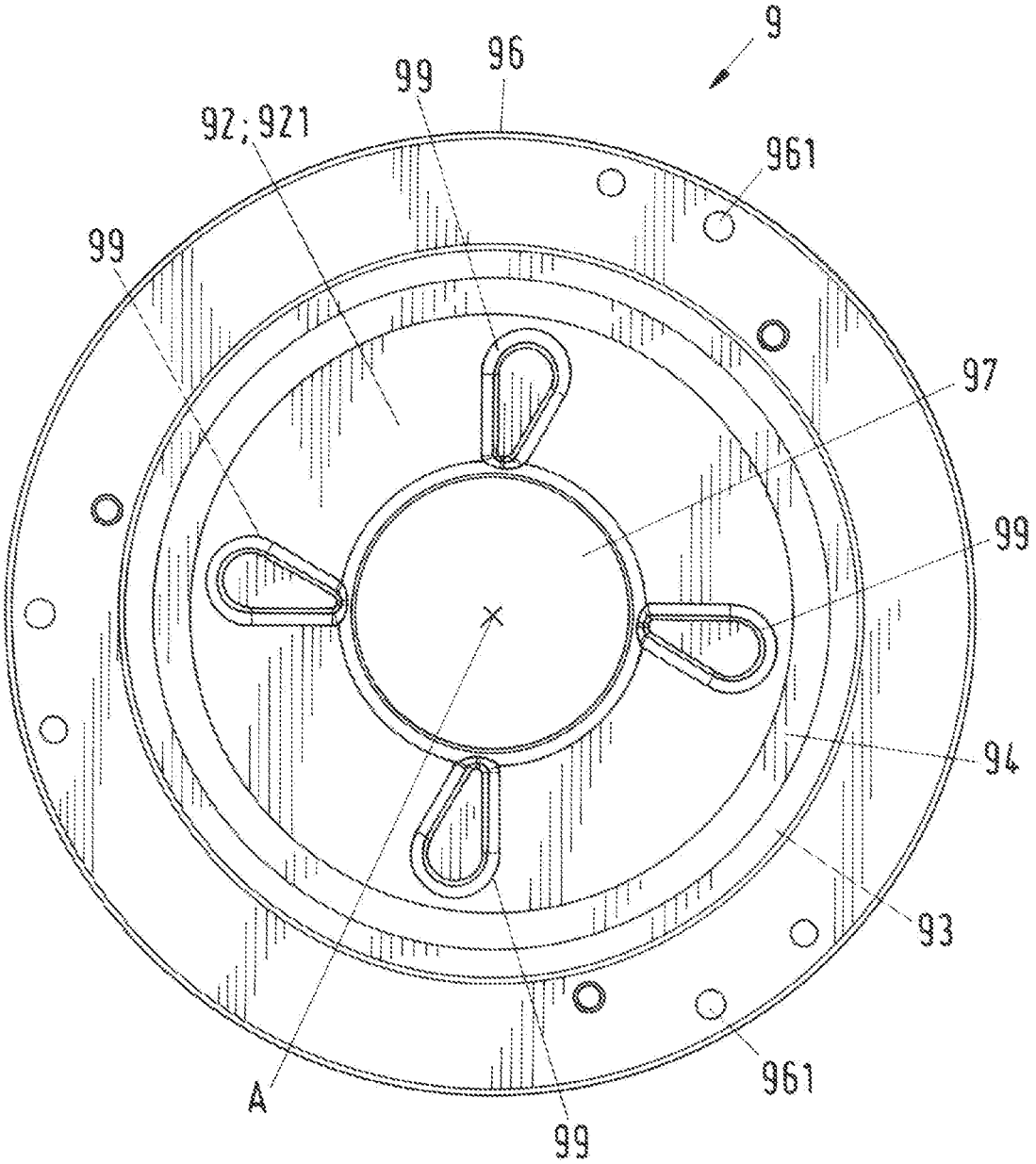
FIG. 5 is a bottom view of the diffusor as seen from the first stage impeller.
Figure 6:
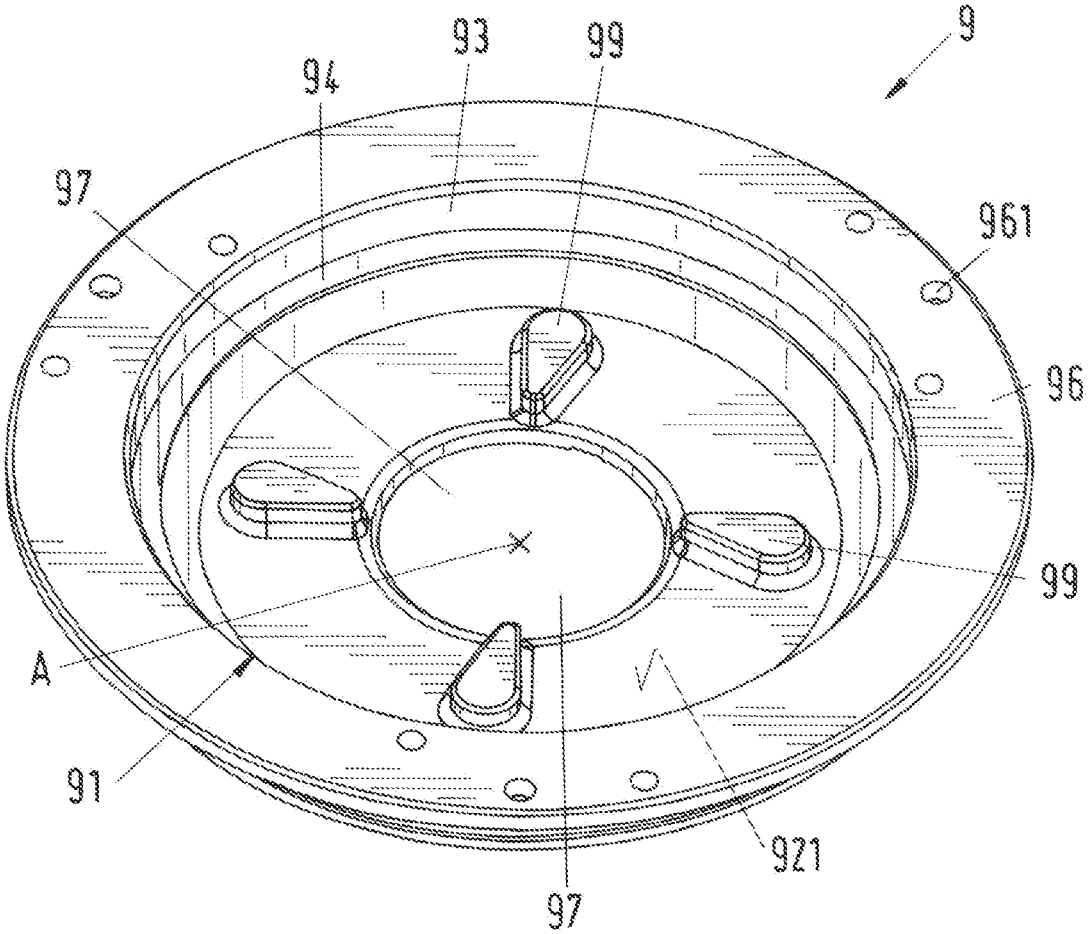
FIG. 6 is a perspective view on the bottom side of the diffusor.
Figure 7:
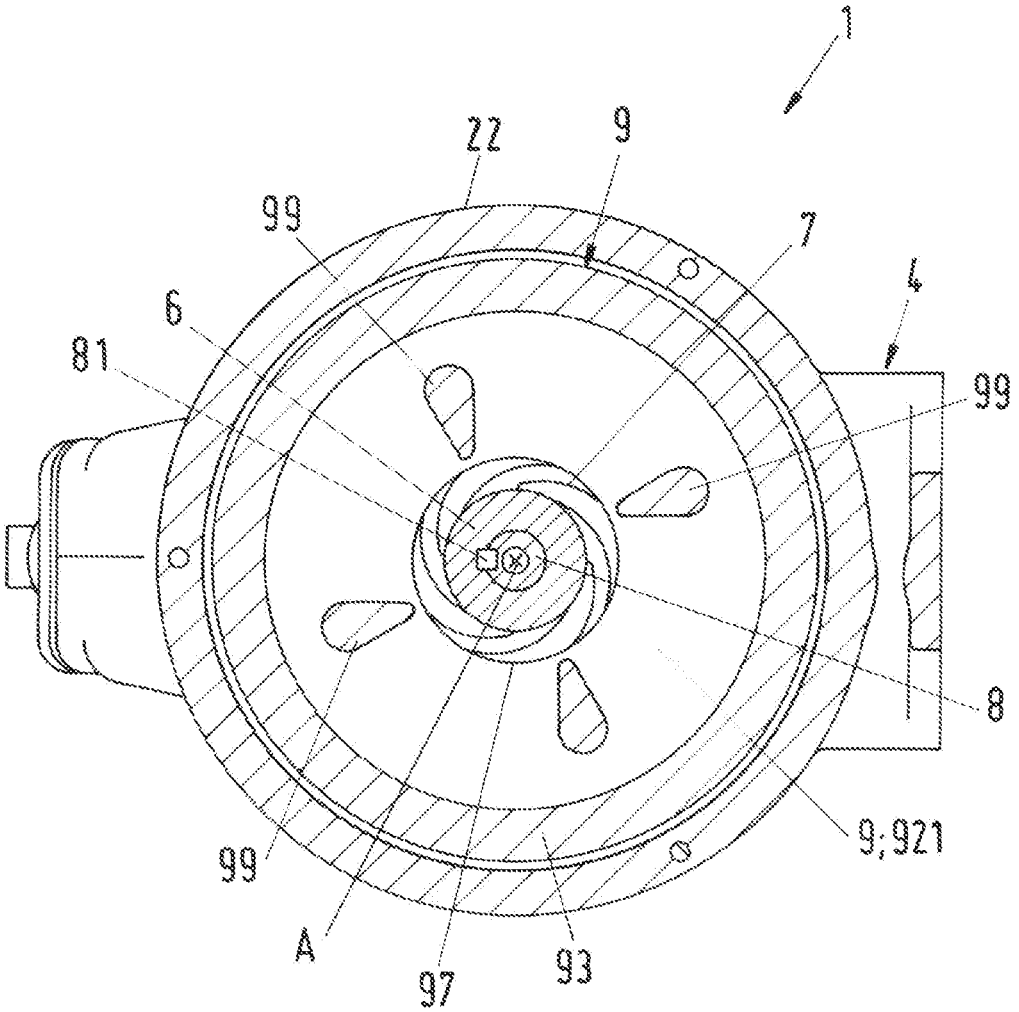
FIG. 7 is a cross-sectional view of the diffusor in a section perpendicular to the axial direction.
Figure 8:
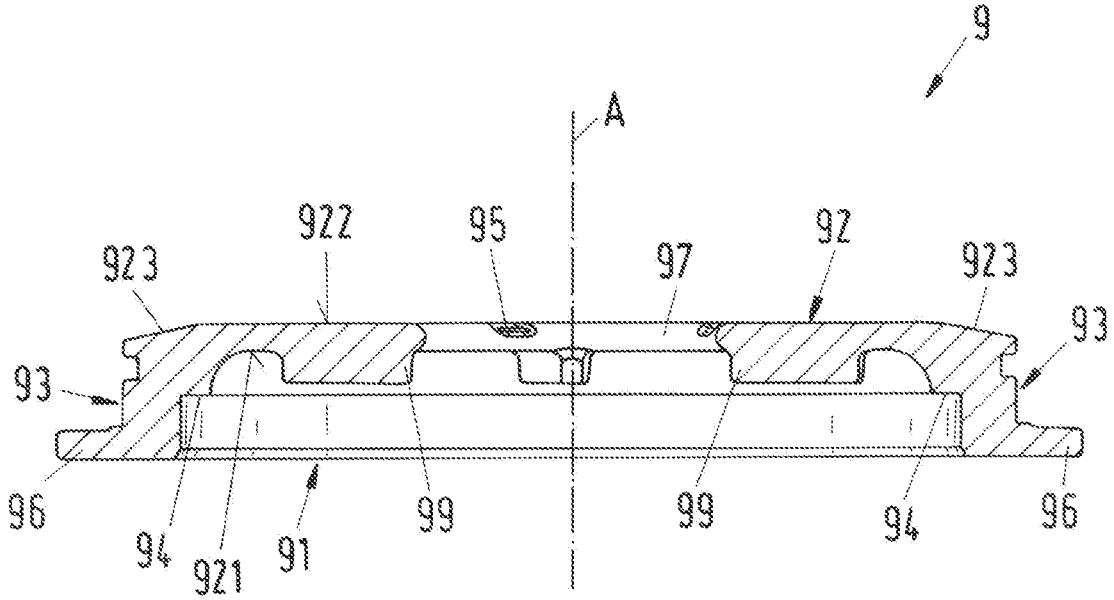
FIG. 8 is a cross-sectional view of the diffusor in a section along the axial direction.

FIG. 4-FIG. 8 show different views of the diffusor 9. FIG. 4 is a top view of the diffusor 9 as seen from the second stage impeller 7. FIG. 5 is a bottom view of the diffusor 9 as seen from the first stage impeller 6. FIG. 6 is a perspective view on the bottom side of the diffusor 9 in a viewing direction from the first stage impeller 6. FIG. 7 is a cross-sectional view of the diffusor 9 in a section perpendicular to the axial direction A. FIG. 8 shows a cross-sectional view of the diffusor 9 in a section along the axial direction A.

The stationary diffusor 9 is designed as a semi-open diffusor 9, meaning that the diffusor 9 is completely open at one side, namely a bottom side 91 (FIG. 8). The diffusor 9 has a top wall 92, a radially outer side wall 93, which is of generally annular shape, and an open bottom side 91, i.e. no bottom wall. As can be best seen in FIG. 6 and FIG. 8 the diffusor 9 has a generally cup-shaped or pot-shaped design.

In the mounted state (FIG. 1) the top wall 92 of the diffusor 9 extends mainly perpendicular to the axial direction A and is arranged adjacently to the second stage impeller 7 and the open bottom side 91 faces the first stage impeller 6. The opening of the open bottom side 91 of the diffusor 9 has a circular shape and is coaxially with the shaft 8. The diameter of the opening of the open bottom side 91 is larger than the outer diameter of the first stage impeller 6, so that the open bottom side 91 extends beyond the first stage impeller 6 with respect to the radial direction.

The top wall 92 includes a central outlet opening 97 having a circular shape. The central outlet opening 97 is arranged in the center of the top wall 92 and surrounds the shaft 8 of the pump 1.

The diffusor 9 is arranged coaxially with the first and the second stage impeller 6, 7, and fixed to the housing 2 in a manner that will be described hereinafter. Thus, the central outlet opening 97 is arranged coaxially with the shaft 8, so that in the mounted state a ring-shaped opening exists around the shaft 8 through which the fluid enters the second chamber 71 for being acted upon by the second stage impeller 7.

The top wall 92 includes a plurality of diffusor elements 99 for guiding the fluid from the first stage impeller 6 to the second stage impeller 7. The diffusor elements 99 support the transformation of kinetic energy (velocity) of the fluid into pressure of the fluid. The diffusor elements 99 are arranged at the lower surface 921 of the top wall 92, so that each diffusor element 99 extends with respect to the axial direction A towards the first stage impeller 6. The extension of the diffusor elements 99 in axial direction A is such that the diffusor elements 99 end in close vicinity to the first impeller blades 62 of the first stage impeller 6. The axial distance between the diffusor elements 99 and the first impeller blades 62 is at least sufficient to constitute a running clearance between the diffusor elements 99 and the first impeller blades 62, so that the first impeller blades 62 can freely rotate beneath the diffusor elements 99.

Regarding the design of the diffusor elements 99 there is a lot of different possibilities and variations. For example, the diffusor elements 99 may be configured as diffusor vanes both as straight vanes extending e.g. in radial direction and as curved vanes. Also the number of diffusor elements 99 may vary, e.g. depending on the specific application. The configuration and the number of the diffusor elements should be such that there is sufficient space between the diffusor elements 99 to avoid a clogging of the diffusor 9. It is however preferred that there are at least four diffusor elements 99 at the lower surface 921 of the top wall 92. It is a further preferred measure that the diffusor elements 99 are equidistantly distributed with respect to the circumferential direction of the top wall 92.

In the embodiment of the diffusor 9 illustrated in FIG. 4 to FIG. 8 the top wall 92, more precisely the lower surface 921 of the top wall 92 includes exactly four diffusor elements 99. As can be best seen in FIG. 5 and FIG. 6, the diffusor elements 99 are equidistantly distributed with respect to the circumferential direction of the top wall 92, i.e. the angular distance between adjacent diffusor elements is 90°.

Each diffusor element 99 extends generally in the radial direction along the lower surface 921 of the top wall 92. Each diffusor element 99 has an essentially drop-shaped design with a thinner end and a rounded larger end. The thinner end of each diffusor element 99 is arranged at the central outlet opening 97, preferably each thinner end is aligned with the central outlet opening 97 (with respect to the axial direction A). From there each diffuser element 99 extends generally in radial direction to the rounded larger end. As can be best seen in FIG. 5, the extension of each diffuser element 99 is not exactly directed radially outwardly, but slightly inclined with respect to a radial line connecting the center with the circumference and being perpendicular to the circumference. The diffusor elements 99 do not extend over the entire lower surface 921 of the top wall 92, but each larger end of the diffusor elements 99 is located a distance away from the radially outer rim of the lower surface 921. The extension of each diffusor element 99 with respect to the radial direction is such, that the first stage impeller 6 and in particular the first impeller blades 62 project beyond each diffusor element 99 regarding the radial direction. By this measure it is ensured that the diffusor elements 99 do not overlap with the annular flow channel 63 of the first chamber 61.

The diffusor 9 further comprises an inner shoulder 94 arranged in the region between the side wall 93 and the lower surface 921 of the top wall 92. At the shoulder 94 the inner diameter of the diffusor 9 decreases in a step-like manner when viewed in a direction towards the top wall 92. The inner shoulder 94 extends along the entire inner circumference of the diffusor 9 and serves for connecting the diffusor 9 to the housing 2.

The top wall 92 of the diffusor has a top surface 922 facing the second stage impeller 7. As can be best seen in FIG. 4 and FIG. 8, the top surface 922 extends mainly in a plane perpendicular to the axial direction A. The top surface 922 comprises a radially outer rim 923, which is inclined downwardly. The top surface 922 includes a plurality of grooves 95 for cleaning out solid constituents of the fluid, which passed the diffusor 9, so that such constituents do not clog the second stage impeller 7.

Each groove 95 (FIG. 4) is designed as a curved groove 95 and extends from the central outlet opening 97 outwardly along the top surface 922. In addition, each groove 95 is designed as an interrupted groove 95, meaning that the groove 95 has a radially inner part 951 and a radially outer part 952 as well as an interruption 953 there between, which is formed by a groove-free section of the top surface 922. The radially inner part 951 of each groove 95 ends in the central outlet opening 97 and the radially outer part 952 of each groove 95 extends into the radially outer rim 923 of the top surface 922.

During operation the radially inner parts 951 of the grooves 95 generate, in interaction with the second stage impeller 7, pulsations or pressure fluctuations in the fluid preventing solid constituents from sticking in particular to the second impeller blades 72 of the second stage impeller 7. The radially outer parts 952 of the grooves 95 shall generate a relative movement of the solid constituents to the second stage impeller 7 and further comminute the solid constituents by a cutting effect. The groove-free interruption 953 between the inner part 951 and the outer part 952 prevents a direct flow communication between the inner part 951 and the respective outer part 952. Therewith the radial backflow of the fluid is considerably reduced whereby the efficiency is increased.

Regarding the number and the specific configuration of the grooves 95 a lot of variations are possible. In the embodiment illustrated in FIG. 4 there are provided four interrupted grooves 95, which are equidistantly distributed with respect to the circumferential direction of the top surface 922.

The diffusor 9 further comprises a mounting flange 96 for attaching the diffusor 9 to the housing 2. As can be seen for example in FIG. 6 and FIG. 8, the mounting flange 96 is disposed at the side wall 93 of the diffusor 9. The mounting flange 96 is designed as an annular flange extending along the entire outer circumference of the diffusor 9. The mounting flange 96 comprises a plurality, here three, bores 961 being equidistantly distributed along the circumference of the mounting flange 96. Each bore 961 is configured to receive a securing element 90 (FIG. 1), e.g. a screw or a bolt, for fixing the diffusor 9 to the housing 2. Particularly preferred, the mounting flange 96 is designed and arranged in such a manner that the securing elements 90 are accessible from the outside of the pump 1, as it is shown in FIG. 1.

Preferably, the diffusor 9 is one-pieced, i.e. the top wall 92, the side wall 93, the mounting flange 96 and the diffusor elements 99 are integrally formed, for example by machining.

For fixing the diffusor 9 to the housing 2 of the centrifugal grinder pump 1 (FIG. 1) the diffusor 9 is placed between the base plate 21 and the pump casing 22 such that the mounting flange 96 overlaps with the lower end of the pump casing 22 with respect to the radial direction. The securing elements 90 are inserted into the bores 961 of the mounting flange 96 and secured, for example by screwing, to the pump casing 22, so that the diffusor 9 is firmly fixed to the pump casing 22. The base plate 21 is designed with an outer annular rim 211 (FIG. 1) protruding in the axial direction A. The outer annular rim 211 of the base plate 21 is inserted into the diffusor 9 from the bottom side 91 of the diffusor 9 until the outer annular rim 211 of the base plate 21 abuts against the inner shoulder 94 of the diffusor 9. Then, the base plate 21 is fixed to the diffusor 9 or to the pump casing 22 by screws or bolts or other fixing elements. Preferably, the base plate 21 and its outer annular rim 211 are configured in such a manner that the outer annular rim 211 is flush with the inner shoulder 94. As can be seen in FIG. 1 the first chamber 61 is delimited both by the base plate 21 and the diffusor 9.

In the mounted state the top wall 92 of the diffusor 9 separates the first chamber 61 from the second chamber 71.

The lower surface 921 of the top wall 92 forms the cover or the ceiling of the first chamber 61 and the top surface 922 of the top wall 92 forms the bottom of the second chamber 71.

It is a particular advantage that the flow area between the annular flow channel 63 surrounding the first stage impeller 6 and the diffusor 9 is completely open along the entire annular flow channel 63. There is no partition or any other element that would hinder the flow from the annular flow channel 63 into the diffusor 9. The flow cross-section being available for the fluid to enter the diffusor 9 is essentially equal with the entire cross-sectional area of the annular flow channel 63 surrounding the first stage impeller 6. This very open design is particularly advantageous for preventing a clogging of the pump 1.

During operation of the multistage centrifugal grinder pump 1 the fluid, e.g. the sewage, enters the pump 1 through the pump inlet 3 and the grinder 5 at the pump inlet 3. Solid constituents in the sewage such as paper, cloths and so on, are shredded by the grinder 5 and the fluid flows into the first chamber 61 where it is acted upon by the centrifugal first stage impeller 6. The first stage impeller 6 conveys the fluid to the flow channel 63 of the first chamber 61. From there the fluid enters the diffusor 9, is guided by the diffusor elements 99 radially inwardly towards the shaft 8. The fluid is discharged from the diffusor 9 through the central outlet opening 97 and enters the second chamber 71 flowing essentially in the axial direction A towards the centrifugal second stage impeller 7. The second stage impeller 7 conveys the fluid into the flow channel 73 of the second chamber 71 from where the fluid is discharged through the pump outlet 4 of the pump.

The multistage grinder pump 1 according to the invention is in particular suited for generating a high head. For example, with a configuration as a two stage pump 1 a head of 60 m or even more may be generated. Typical flow rates are for example in the range of 1 $m^3$/h to 7 $m^3$/h. The grinder pump 1 according to the invention may be used for residential pressure sewerage systems (PSS) or in conventional gravity sewerage applications. The grinder pump 1 according to the invention provides effective and economical dewatering in private, municipal and industrial areas, in particular, when using small-diameter discharge lines.

The multistage centrifugal grinder pump 1 has been explained referring to an embodiment having two stages. It has to be understood that the invention is not restricted to embodiments with two pump stages. In other embodiments the multistage centrifugal grinder pump may comprise more than two stages, e.g. three or four or even more stages. In an analogous manner as it has been described hereinbefore a diffusor is arranged axially between each pair of adjacent stages. Thus, between each pair of adjacent stage impellers a diffusor is provided to direct the flow of fluid to the next stage impeller. When N designates the number of stages of the multistage centrifugal grinder pump, the number of diffusers is N−1.

What is claimed:

1. A multistage centrifugal grinder pump, comprising:

a housing including a base plate with an inner surface, a pump inlet for a fluid to be conveyed, and a pump outlet for discharging the fluid;

a grinder arranged at the pump inlet configured to grind constituents of the fluid;

a first stage impeller configured to rotate about an axial direction;

a second stage impeller configured to rotate about the axial direction;

a stationary diffusor having an inner surface and being arranged with respect to the axial direction between the first stage impeller and the second stage impeller, and the inner surface of the stationary diffuser arranged adjacent to and abutting the inner surface of the base plate to form a flow channel that surrounds the first stage impeller to enable the fluid to flow radially outwardly from the first stage impeller to the second stage impeller, and to transform kinetic energy of the fluid into pressure; and a shaft configured to rotate the first stage impeller, the second stage impeller and the grinder, the first stage impeller and the second stage impeller arranged in series and connected to the shaft in a torque-proof manner, and the diffusor being a unitarily formed semi-open diffusor having a top wall and a lower surface, a radially outer annular side wall, and a bottom side facing the first stage impeller, the bottom side having an opening, the top wall arranged adjacently to the second stage impeller, the top wall having a central outlet opening surrounding the shaft, and the opening in the bottom side extending beyond the first stage impeller with respect to a radial direction, the top wall extending mainly perpendicular to the axial direction and being arranged adjacently to the second stage impeller, and the lower surface extending mainly perpendicular to the axial direction and being arranged adjacently to the first stage impeller.

2. The multistage centrifugal grinder pump in accordance with claim 1, further comprising a pump chamber accommodating the impellers, the diffusor dividing the pump chamber into a first chamber, in which the first stage impeller is arranged, and a second chamber, in which the second stage impeller is arranged.

3. The multistage centrifugal grinder pump in accordance with claim 2, wherein the first chamber and the second chamber each have a circular cross-section perpendicular to the axial direction.

4. The multistage centrifugal grinder pump in accordance with claim 1, wherein a plurality of diffusor elements is disposed on the lower surface of the diffusor and configured to guide the fluid from the first stage impeller to the second stage impeller and configured to transform kinetic energy of the fluid into pressure of the fluid, with each diffusor element extending with respect to the axial direction towards the first stage impeller.

5. The multistage centrifugal grinder pump in accordance with claim 4, wherein each diffusor element is arranged at the central outlet opening of the top wall and extends in the radial direction, with the extension in the radial direction being such, that the first stage impeller projects beyond each diffusor element regarding the radial direction.

6. The multistage centrifugal grinder pump in accordance with claim 4, wherein the diffusor elements are equidistantly distributed with respect to a circumferential direction of the top wall of the diffusor.

7. The multistage centrifugal grinder pump in accordance with claim 4, wherein the plurality of diffusor elements includes at least four diffusor elements.

8. The multistage centrifugal grinder pump in accordance with claim 4, wherein the plurality of diffusor elements includes exactly four diffusor elements.

9. The multistage centrifugal grinder pump in accordance with claim 1, wherein the top wall of the diffusor has a top surface facing the second stage impeller, and the top surface includes a plurality of grooves configured to clean out solid constituents of the fluid.

10. The multistage centrifugal grinder pump in accordance with claim 1, wherein the diffusor comprises a mounting flange configured to attach the diffusor to the housing, and a plurality of securing elements arranged at the mounting flange to fix the diffusor to the housing, the mounting flange configured and arranged in such a manner that the securing elements are accessible from outside of the pump.

11. The multistage centrifugal grinder pump in accordance with claim 10, wherein the base plate is arranged at the pump inlet, and the housing further comprises a pump casing delimiting the pump chamber, the diffusor being fixed to the pump casing.

12. The multistage centrifugal grinder pump in accordance with claim 11, wherein the diffusor is interposed between the base plate and the pump casing.

13. The multistage centrifugal grinder pump in accordance with claim 1, further comprising a drive unit configured to rotate the shaft about the axial direction, the drive unit arranged within the housing, and the first stage impeller and the second stage impeller are arranged between the drive unit and the grinder with respect to the axial direction.

14. The multistage centrifugal grinder pump in accordance with claim 13, wherein the pump is configured for vertical operation with the shaft extending in a vertical direction, and the drive unit arranged above the first stage impeller and the second stage impeller.

15. The multistage centrifugal grinder pump in accordance with claim 1, wherein the pump is a submersible pump.

16. The multistage centrifugal grinder pump in accordance with claim 1, wherein the pump is a two stage pump.

17. The multistage centrifugal grinder pump in accordance with claim 1, wherein the grinder includes a cutting device and is fixed to the shaft.

18. The multistage centrifugal grinder pump in accordance with claim 1, wherein the grinder is configured to rotate during operation to shred or disintegrate solid constituents of the fluid.

* * * * *